US008412028B2

(12) United States Patent
Zhu

(10) Patent No.: US 8,412,028 B2
(45) Date of Patent: Apr. 2, 2013

(54) THREE-DIMENSIONAL FLAME SIMULATING ELECTRIC FIREPLACE

(75) Inventor: Hongfeng Zhu, Zhejiang (CN)

(73) Assignee: Yiwu Andong Electrical Appliances Co., Ltd., Yiwu, Zhejiang (CN)

( * ) Notice: Subject to any disclaimer, the term of this patent is extended or adjusted under 35 U.S.C. 154(b) by 579 days.

(21) Appl. No.: 12/602,153

(22) PCT Filed: May 30, 2008

(86) PCT No.: PCT/CN2008/001072

§ 371 (c)(1), (2), (4) Date: Nov. 29, 2009

(87) PCT Pub. No.: WO2008/145025

PCT Pub. Date: Dec. 4, 2008

(65) Prior Publication Data

US 2010/0172636 A1 Jul. 8, 2010

(30) Foreign Application Priority Data

May 31, 2007 (CN) ..... 2007 1 0069143

(51) Int. Cl.
*F24B 1/18* (2006.01)

(52) U.S. Cl. ..... 392/348; 40/428

(58) Field of Classification Search ..... 392/348; 40/428

See application file for complete search history.

(56) References Cited

U.S. PATENT DOCUMENTS 3,699,697 A * 10/1972 Painton ..... 40/428
4,965,707 A * 10/1990 Butterfield ..... 362/96
5,642,580 A * 7/1997 Hess et al. ..... 40/428
6,047,489 A * 4/2000 Hess et al. ..... 40/428
6,363,636 B1 * 4/2002 Hess et al. ..... 40/428
6,393,207 B1 * 5/2002 Martin et al. ..... 392/348
7,080,472 B2 * 7/2006 Schroeter et al. ..... 40/428
7,162,820 B2 * 1/2007 Hess et al. ..... 40/428
7,236,693 B2 * 6/2007 Haugom ..... 392/348
7,826,727 B2 * 11/2010 Bourne ..... 392/410
8,019,207 B2 * 9/2011 Zhou ..... 392/348
2002/0095832 A1 * 7/2002 Hess et al. ..... 40/428
2005/0086841 A1 * 4/2005 Schroeter et al. ..... 40/428
2005/0097793 A1 * 5/2005 Hess ..... 40/428

* cited by examiner

*Primary Examiner* — Thor Campbell

(74) *Attorney, Agent, or Firm* — Global IP Services; Tianhua Gu

(57) ABSTRACT

The present invention relates to an electric fireplace having a 3D flame simulating assembly, which comprises housing, an imaging light source, a light processing unit and a simulated charcoal disposed in front of the inner cavity of said housing. A translucent imaging screen is positioned against the back of the simulated charcoal and a second translucent imaging screen is positioned just in front of and parallel to the translucent imaging screen. The light emitted from the imaging light source is projected onto the imaging screen to form a primary simulated flame image after passing through the light processing unit, and portion of which is further projected onto the second imaging screen to form a secondary simulated flame image after passing through the image screen. If the distance between the imaging screen and the second imaging screen is kept to be enough, a visual effect of rising and leaping simulated flames with spatial depth is generated due to the different front to back positions of the flame images imaged on both screens.

8 Claims, 3 Drawing Sheets

THREE-DIMENSIONAL FLAME SIMULATING ELECTRIC FIREPLACE

The present application is the U.S. national stage of PCT/CN2008/001072 filed on May 30, 2008, which claims the priority of the Chinese patent application No. 200710069143.8 filed on May 31, 2007, which application is incorporated herein by reference.

FIELD OF THE INVENTION

The present invention relates to a heater, in particular, to an electric fireplace having a 3D flame simulating assembly.

BACKGROUND OF THE INVENTION

Electronic flame or simulated flame is usually used in electric fireplace having flame simulating assembly to produce vision and decorative effect. The traditional flame simulating assembly used in electric fireplace is generally divided into two types. For the first type, a set of silk strips, which are hung over the simulated fuel and positioned behind a translucent plastic screen and reflective glass, simulate the flicker flame via wobbling lights which is produced in the way that strips are blew by air and projected on to the reflective glass, as is disclosed in patent ZL200420025266.3 entitled ELECTRIC FIREPLACE HEATER. For the second type, a dynamic light source driven by an electric motor, a set of tree-branches-like simulated charcoal, a flame template wall, a transparent screen and a reflective glass are disposed from the back to front in order. Simulated flame—visual image of flame—are formed as the light are shaped by going through the flame template wall lights and projected on the transparent screen and reflective glass, of which the source is the dynamic light source with motor coming from the rotating vanes or source light going though the holes on the flame template wall, as is disclosed in patent application NO. 01113160.8 entitled FLAME SIMULATING ASSEMBLY IN ELECTRIC HEATER. The two types of flame simulating assembly both can produce a visual image of flicker flames, but these assemblies which use projection to form an image on one imaging screen produce a very flat vision impression that the flames seems burning behind a simulated burning charcoal set and are lack of spatial depth and three-dimensional vision in actual charcoal burning.

SUMMARY OF THE INVENTION

The object of the present invention is directed to solve the technical problems existing in the prior art that the simulated flames are lack of spatial depth and to provide an electric fireplace having a 3D flame simulating assembly.

According to one exemplary embodiment, the present invention relates to an electric fireplace having a 3D flame simulating assembly, comprising a housing, an imaging light source, a light processing unit, a simulated charcoal disposed in front of the cavity of said housing and a translucent imaging screen positioned adjacent to said simulated charcoal; wherein, a second imaging screen is disposed in front of said imaging screen, said second imaging screen is approximately parallel to said imaging screen. The light emitted from the imaging light source is projected onto the imaging screen to form a primary simulated flame image after passing through the light processing unit, and portion of which is further projected onto the second imaging screen to form a secondary simulated flame image after passing through the image screen. If the distance between the imaging screen and the second imaging screen is kept to be enough, a visual effect of rising and leaping simulated flames with spatial depth is generated due to the different front to back positions of the flame images imaged on both screens. Moreover, a visual effect of up-and-down flame is generated because the light projected to two imaging screens simultaneously is difference and the height of simulated flames is difference too. The imaging screen and the second imaging screen are disposed behind and in front of but both above the simulated charcoal respectively, which leads to a realistic 3D surrounding fire field with spatial depth covered on the simulated charcoals. This structure is simple and easy to be utilized, and the visual effect of simulated flame is more realistic and more accordant to the actual charcoal burning.

As a preferred embodiment, a plurality of embossments with various heights are disposed on the side face of said second imaging screen which is opposite to said imaging screen, the height of said embossments is 0.05-0.2 mm. The embossments with different height disposed on the side face create a irregular rough or frosting surface. The imaging lights projected on the surface are refracted by the surface with irregular embossments to form a simulated flame image which can be viewed from various viewing angle. Thus a better visual effect of simulated flame is achieved.

As a preferred embodiment, said imaging screen is a glass plate or a plastic plate or a translucent plate superposed by said two plates. The imaging screen made of said material is easy to make in low cost and good in simulated visual effect.

As a preferred embodiment, said second imaging screen has internal colored coating or external colored transparent coating. A better color selected according to the color properties of actual burning flames can enhance the simulating effect of flame. The internal color are gotten by filling colorant into said imaging screen; the color coating is transparent or translucent. The internal color coating or external transparent coating can increase the strength of the imaging screen, the lighting effect, and the contrast of light and dark of simulated image.

As a preferred embodiment, the sides face of said second imaging screen which is opposite to said imaging screen is a concave or convex surface. This kind of setting can make the flame image clearer or magnify the flame image, which are an optional according to operating requirement in order to extend scope of application.

As a preferred embodiment, said second imaging screen is disposed at the facade opening wall of said housing. The second imaging screen disposed at the façade opening wall directly is used to form an image as long as enclose the façade opening of said housing. Thus the structure of said housing can be simplified without additional closing wall disposed at the opening. Moreover, the flame images transmit directly through the second imaging screen before the eyes of a user, which can save light energy and achieve a clearer display effect.

As a preferred embodiment, an air duct of internal heater is disposed at the bottom of said housing said air duct is disposed below said imaging light source, said light processing unit and said simulated charcoals. An electric heating device is usually used in the electric fireplace as a heater. The air around the electric heating device is heated and sent out by a fan thereof to warm the room. The electric heater is connected with the air duct which sends the warm air forward to area in front of the electric fireplace.

As a preferred embodiment, said air duct includes a body with an outlet port at front end, an inlet port at rear end and closed sidewalls, said body approaches from rear end to front end in the form of contracting vertically and expanding horizontally to shape said body with a structure that lower and wide in front and higher and narrow behind, the outlet port appears flat vertically. The design that the distance between the both side walls of the main body of the air duct extends horizontally from the rear end to front end can form and export warm air from the air duct in Fan-Shape, which increases the scope of effective warm area. Gradually reduced distance between the upper and bottom walls of the air duct in vertical direction is in favor of compressing the flow area of outlet port, forming a certain air-outtake resistance and a certain air-pressure in the cavity, which increases the wind velocity passing through the air duct and also to increase the effective distance of air-sending. The upper plate of the air-duct can spread and reach to the side wall of the electric fireplace, and the base plate of the electric fireplace could also be used as the lower plate of the air duct for material saving. The air duct with this structure can make the outer profile of the electric fireplace more simplicity and beautiful.

As a preferred embodiment, s said light processing unit is a light reflecting device consisted of a shaft driven by an electric motor and reflective stripes disposed on said shaft. Driven by the motor, the reflective strips disposed on the shaft form and create a simulated dynamic flame on the imaging screen. As a preferred embodiment, said shaft is bent into U-shape or V-shape or wave shape, a pilot sleeve is mounted on one end or both ends of said shaft, the angle between the centerline of the pilot hole of said pilot sleeve and the horizontal line is acute. The shaft bends naturally by the co-action of self weight and the force applied by the pilot sleeve disposed on one end of the shaft; the shaft bends to form a curved shape under the action of pilot sleeve disposed on both ends of the shaft. Thus, driven by the driving mechanism, the shaft, with curved shape itself and bending by the external force, rotates to produce a big fluctuated trajectory and the same light effect reflected from the reflective strips disposed on the shaft, and in turn to simulate an effect of big rising and leaping flames. The wobbling of the rotating elastic shaft also enhances the varieties of simulated flames.

It should be known that the flame imaging assembly is described with the reflective types as its preferred embodiment according to the present invention. It is obvious that same can be applied to other imaging devices without being departure from the spirit and scope of the present invention.

Therefore, the present invention has the features of rational construction and easy making, and particularly can create a more realistic simulated flame with a spatial depth.

BRIEF DESCRIPTION OF THE DRAWINGS

FIG. 1*a* is a structural view showing the screen (4) is a convex surface; FIG. 1*b* is a structural view showing the screen (4) is a concave surface.

DETAILED DESCRIPTION OF THE INVENTION

The present invention will be further described by the following preferred embodiment in conjunction with the drawings thereof.

Figure 1:
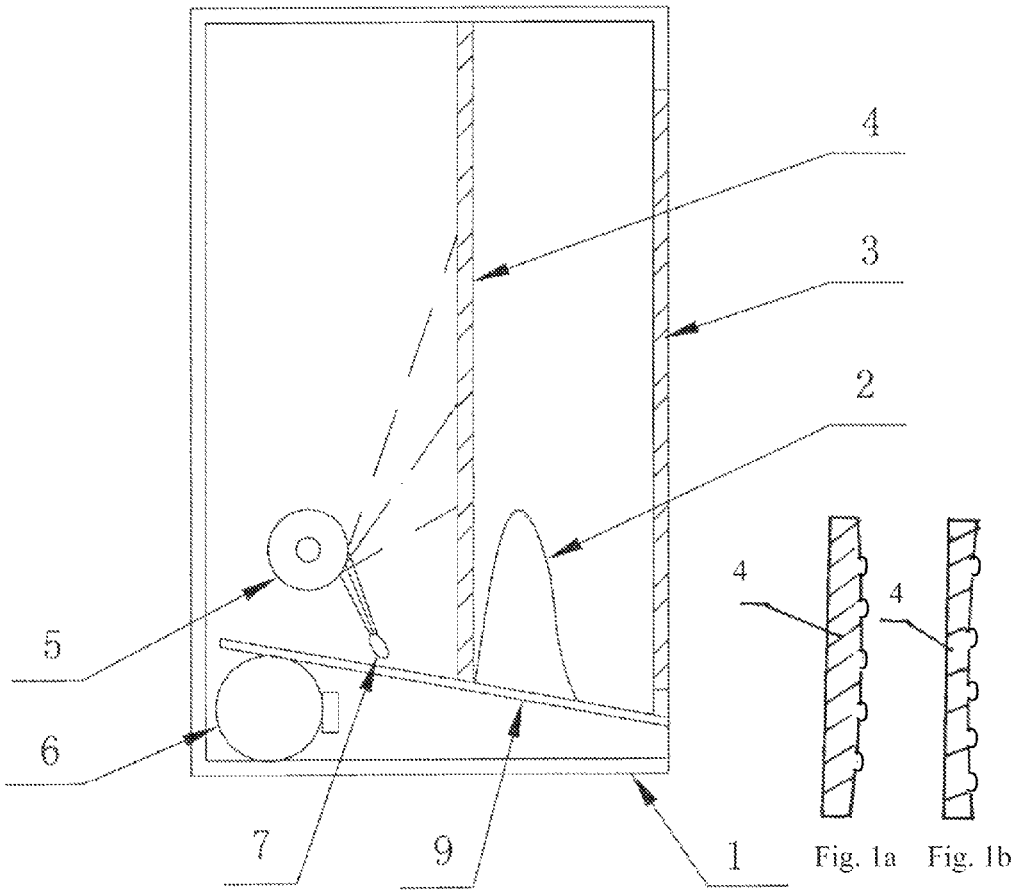
FIG. 1 is a structural view showing an embodiment of an electric fireplace having a 3D flame simulating assembly according to the present invention.
Figure 2:
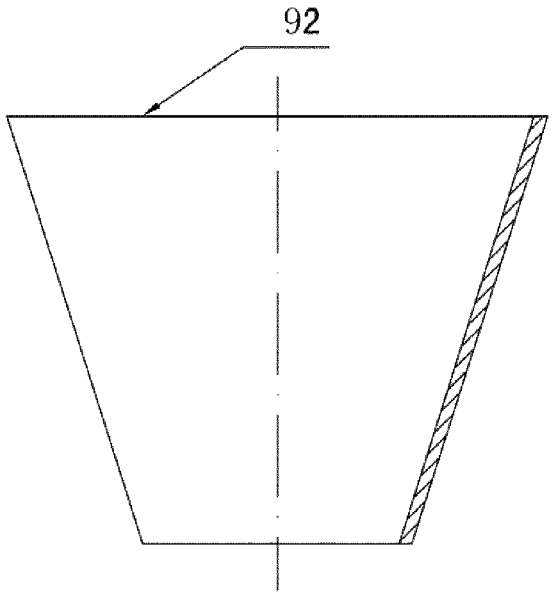
FIG. 2 is a structural view of the air duct.
Figure 3:
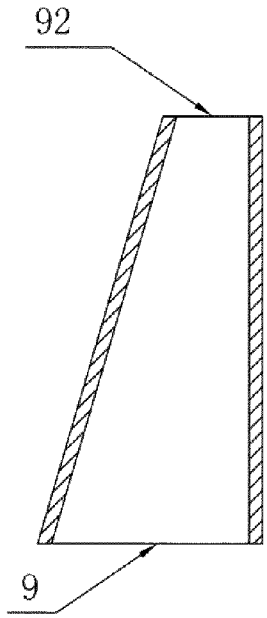
FIG. 3 is a side view of FIG. 2.
Figure 4:
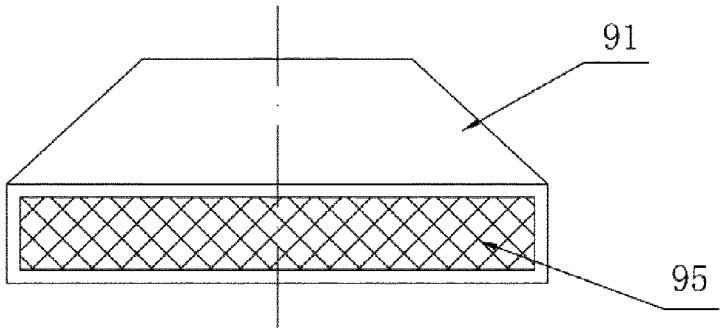
FIG. 4 is a top view of FIG. 2.

First referring to FIG. 1, the embodiment according to present invention is an electric fireplace having a 3D flame simulating assembly, which comprises a housing 1 of the electric fireplace, an imaging light source 7, light processing unit 5, simulated charcoal 2, translucent imaging screen 4 positioned against the back of the simulated charcoal 2, and the second imaging screen 3 in front of and approximately parallel to the imaging screen 4. The light emitted from the imaging light source is projected onto the imaging screen 4 to form a primary simulated flame image after passing through the light processing unit 5, and portion of which is further projected onto the second imaging screen 3 to form a secondary simulated flame image after passing through the image screen 4. If the distance between the imaging screen 4 and the second imaging screen 3 is kept to be enough, a visual effect of rising and leaping simulated flames with spatial depth is generated due to the different front to back positions of the flame images imaged on both screens.

The second imaging screen 3, which is made of glass plate, is disposed at the opening on facade wall of the housing 1. A plurality of embossments with various heights are disposed on the side face, which is opposite to the imaging screen 4, of the second imaging screen 3, the height of the embossments is 0.05-0.2 mm. The second imaging screen 3 is internal colored. The sides face of the second imaging screen 3 which is opposite to the imaging screen 4 is a plate or concave.

As shown in FIG. 1, FIG. 2, FIG. 3 and FIG. 4, an air duct 9 of internal heater 6 is disposed at the bottom of said housing 1, the air duct 9 is also disposed below the imaging light source 7, the light processing unit 5 and the simulated charcoals 2. The air duct 9 includes a body 91 with an outlet port at front end, an inlet port at rear end and closed sidewalls. The body 91 approaches from rear end to front end in the form of contracting vertically and expanding horizontally to shape a structure of which to be lower and wide in front and higher and narrow behind, the outlet port 92 appears flat vertically. Further, a protection net 95 is disposed on the outlet port of the air duct 9.

Figure 5:
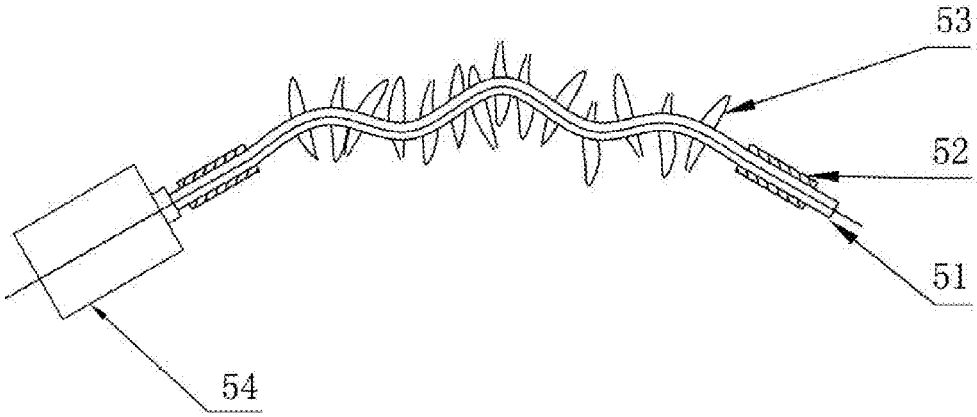
FIG. 5 is a structural view of the flame imaging assembly.

As shown in FIG. 1 and FIG. 5, the light processing unit 5 is consisted of a shaft 51 driven by an electric motor 54 and reflective stripes 53 disposed on the shaft 51. The shaft 51 is bent into U-shape or V-shape or wave shape. A pilot sleeve 52 is mounted on one end or both ends of the shaft. The angle between the centerline of the pilot hole of the pilot sleeve 52 and the horizontal line is acute.

What is claimed is:

1. An electric fireplace having a 3D flame simulating assembly, comprising:

a housing (1), an imaging light source (7), a light processing unit (5), a simulated charcoal (2) disposed in front of a cavity of said housing (1) and a translucent imaging screen (4) positioned adjacent to said simulated charcoal (2); wherein, a second imaging screen (3) is disposed in front of said imaging screen (4), said second imaging screen (3) is approximately parallel to said imaging screen (4), the sides face of said second imaging screen (3) which is opposite to said imaging screen (4) is a concave or convex surface, on which a plurality of embossments with various heights are disposed, the height of said embossments is 0.05-0.2 mm.

2. The electric fireplace having a 3D flame simulating assembly according to claim 1, wherein said imaging screen (4) is a glass plate or a plastic plate or a translucent plate superposed by said glass plate and plastic plate.

3. The electric fireplace having a 3D flame simulating assembly according to claim 1, wherein said second imaging screen (3) has internal colored coating or external colored transparent coating.

4. The electric fireplace having a 3D flame simulating assembly according to claim 1, wherein said second imaging screen (3) is disposed at a facade opening wall of said housing (1).

5. The electric fireplace having a 3D flame simulating assembly according to claim 1, wherein an air duct (9) of internal heater (6) is disposed at the bottom of said housing (1) said air duct (9) is disposed below said imaging light source (7), said light processing unit (5) and said simulated charcoals (2).

6. The electric fireplace having a 3D flame simulating assembly according to claim 5, wherein said air duct (9) includes a body (91) with an outlet port at front end, an inlet port at rear end and closed sidewalls, said body (91) approaches from rear end to front end in the form of contracting vertically and expanding horizontally to shape the structure of which to be lower and wide in front and higher and narrow behind, the outlet port (92) appears flat vertically.

7. The electric fireplace having a 3D flame simulating assembly according to claim 1, wherein said light processing unit (5) is a light reflecting device consisted of a shaft (51) driven by an electric motor (54) and reflective stripes (53) disposed on said shaft (51).

8. The electric fireplace having a 3D flame simulating assembly according to claim 7, wherein said shaft (51) is bent into U-shape or V-shape or wave shape, a pilot sleeve (52) is mounted on one end or both ends of said shaft, the angle between the centerline of the pilot hole of said pilot sleeve (52) and the horizontal line is acute.

* * * * *